US006507263B2

(12) United States Patent
Odendaal et al.

(10) Patent No.: US 6,507,263 B2
(45) Date of Patent: Jan. 14, 2003

(54) MULTI-TERMINAL FOIL WINDINGS

(75) Inventors: Willem G. Odendaal, Yorktown Heights, NY (US); Azevedo Jose, Mahopac, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 35 days.

(21) Appl. No.: 09/827,626

(22) Filed: Apr. 6, 2001

(65) Prior Publication Data

US 2002/0145499 A1 Oct. 10, 2002

(51) Int. Cl.[7] ..... H01F 27/28; H01F 7/06
(52) U.S. Cl. ..... 336/223; 336/192; 29/602.1
(58) Field of Search ..... 29/25.42, 602.1, 29/606, 605; 336/223, 192, 60, 198

(56) References Cited

U.S. PATENT DOCUMENTS 4,368,407 A * 1/1983 Wroblewski ..... 315/291
4,633,368 A * 12/1986 Frederick ..... 361/328
4,879,190 A * 11/1989 Lundsgaard ..... 429/94
5,153,812 A * 10/1992 Naito ..... 361/270
5,644,468 A * 7/1997 Wink et al. ..... 361/330
6,040,086 A * 3/2000 Yoshida ..... 429/211

FOREIGN PATENT DOCUMENTS

JP 406077080 A * 3/1994 ..... 29/602.1

* cited by examiner

*Primary Examiner*—Anh T. Mai

(57) ABSTRACT

The present invention provides a foil winding with multiple high current terminals and a method for producing the foil winding. Conductive foil and insulation film are wound together to form a wound assembly. During winding, temporary pins are placed along the axis at radii where terminals are desired. Foil windings are cut from the wound assembly and terminals pressed into place where the cutoff pins remain in the foil winding from the temporary pins. In an alternate method, a terminal pin can take the place of the temporary pin when winding the wound assembly and remain in the foil winding as the electrical connection to the conductive foil.

21 Claims, 3 Drawing Sheets

MULTI-TERMINAL FOIL WINDINGS

TECHNICAL FIELD

The technical field of this disclosure is electrical windings, particularly, a foil winding with multiple terminals.

BACKGROUND OF THE INVENTION

Foil windings can be used to produce a variety of electronic components, such as transformers and capacitors. Such components often require multiple terminals at different radial positions in the windings. Multiple terminal windings have been produced in large components like large power frequency transformers by cold-welding copper busbars to aluminum foils and in small transformers by acoustic welding of copper terminals to aluminum foil windings. However, multiple terminal windings have not been produced for low profile vertical windings, such as foil wound, low profile transformers and other foil wound, low profile magnetic components.

In small transformers with foil windings, multiple terminals present difficulties in fabrication and operation. It is difficult to maintain terminal alignment during fabrication, creating irregularities in the foil that create electromagnetic irregularities during operation. In addition, misalignment increases the temperature at the center of the winding.

Soldering, ultrasonic welding, spot-welding, and cold welding are common methods for fusing metals and providing good electrical contact, but the welding of terminals in foil windings must be performed before winding the foil. This means that terminals longer than the foil is wide must be cut to their final length and welded to the foil before winding. The welding also adds a complex and time-consuming step to the manufacturing process.

It would be desirable to have a foil winding with multiple terminals that would overcome the above disadvantages.

SUMMARY OF THE INVENTION

One aspect of the present invention provides a foil winding with multiple high current terminals.

Another aspect of the invention provides a foil winding with terminals aligned with the axis of the foil winding.

Another aspect of the invention provides a method of making a foil winding with multiple terminals without soldering or welding the terminals to the foil.

Another aspect of the invention provides a method of making a foil winding with multiple terminals wherein several foil windings are wound simultaneously.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DESCRIPTION OF THE PREFERRED EMBODIMENT

Figure 1:
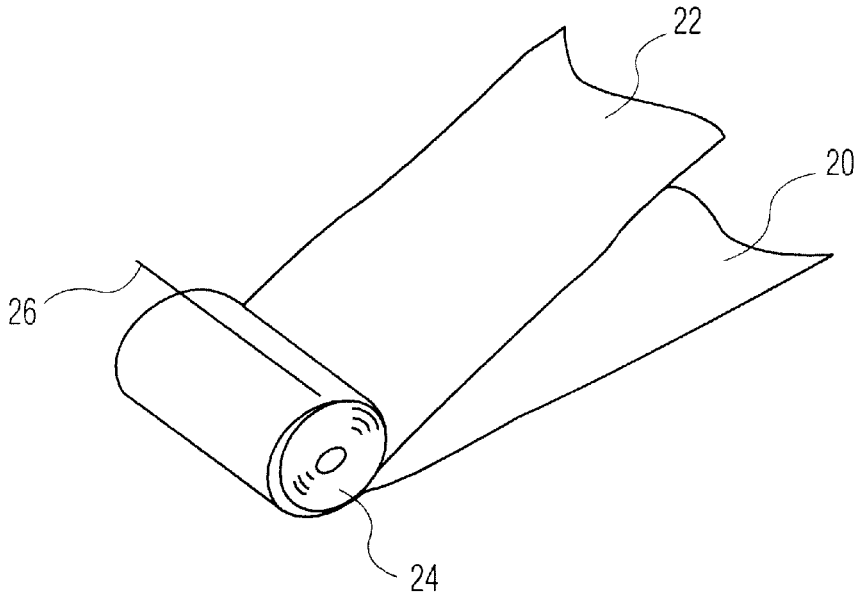
FIG. 1 shows winding foil about a mandrel in accordance with the method of e present invention.

FIG. 1 illustrates winding wide electrically conductive foil 20 with an insulation film 22 on a mandrel 24. The conductive foil 20 can be any metallic or electrically conductive foil. In an alternate embodiment, the conductive foil 20 can comprise several stacked layers of foil, wound in parallel with the insulation film 22. The insulation film 22 can be any electrically insulating film, such as polymer films, including polyethylene terephthalate (PET) film or Mylare® brand polyester film made by DuPont. In one embodiment, the conductive foil 20 can be copper and the insulation film 22 can be polyethylene terephthalate (PET) film. In other embodiments, the conductive foil 20 can be made of gold, silver, or aluminum. Different materials of different thickness can be selected to meet the desired performance and will be well understood by those skilled in the art. In one embodiment, the mandrel 24 has a circular cross-section, but the mandrel 24 can have any cross-section required, such as square or rectangular, to shape the foil winding for the final application. As the winding progresses, temporary pins 26 can be placed in an axial orientation along the mandrel 24 at the radial positions where terminals are required. Multiple temporary pins 26 can be installed at different radii corresponding to the multiple terminal locations. In one embodiment, the temporary pins 26 are made of stainless steel, but they can be made of any material compatible with the other materials and the processing steps including non-metallic materials and ceramics. In another embodiment, the temporary pins 26 can be enclosed in foil sleeves before winding.

Figure 2:
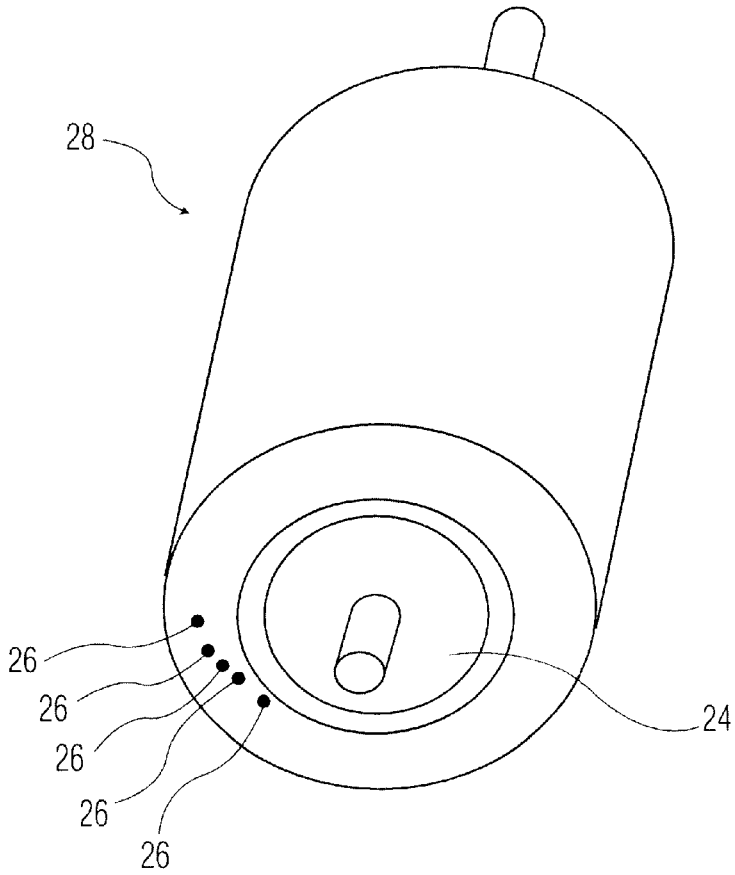
FIG. 2 shows a wound assembly made in accordance with the method of the present invention.

FIG. 2 illustrates a wound assembly 28 with the conductive foil and insulation film fully wound about the mandrel 24 and multiple temporary pins 26 in place. The wound assembly 28 can undergo further processing steps to improve mechanical strength and electrical properties, such as vacuum impregnation and encapsulation, before the individual foil windings are cut from the wound assembly 28. The wound assembly 28 can be cured as required to complete the encapsulation. The vacuum impregnation and encapsulation steps could also be performed for the individual foil windings after they are cut from the wound assembly 28. Once cured, the wound assembly 28 can be cut into foil windings 30 of desired thickness. Multiple foil windings of varying thickness can be cut from a single wound assembly 28. The foil winding 30 can be cut from the wound assembly 28 using conventional techniques, such as inner diameter (ID) diamond saws.

The foil winding 30 can be cut to any thickness required for the particular application. In one embodiment, the diameter is substantially larger than the axial length, creating a vertical winding. In another embodiment, the windings can have a ratio of the foil winding diameter to the foil winding thickness of greater than or equal to 10:1, which is generally considered the ratio for planar or substantially low profile components. The low profile is desirable for circuit board mounting and heat transfer.

Figure 3:
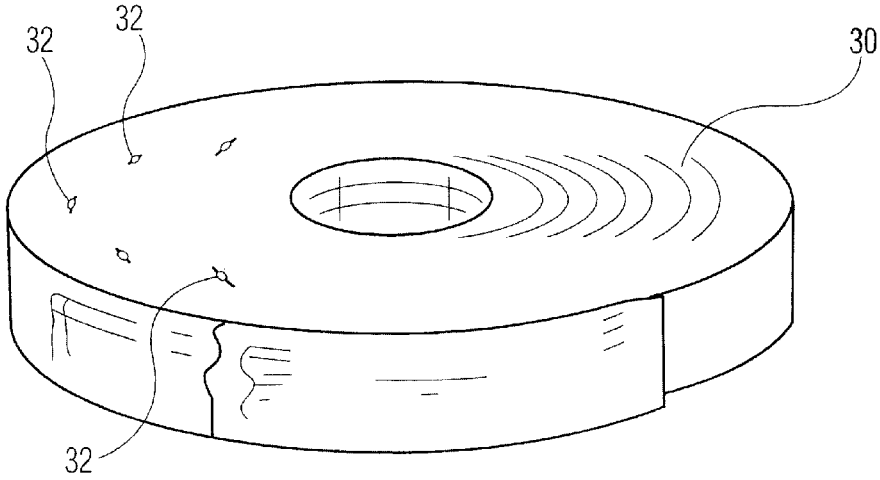
FIG. 3 shows a foil winding made in accordance with the method of the present invention.
Figure 4:
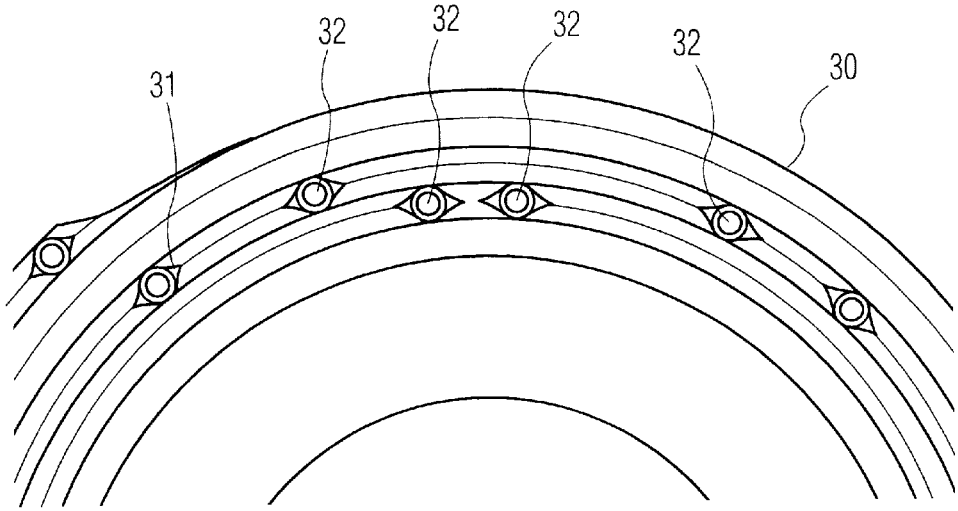
FIG. 4 shows a detailed view of a foil winding made in accordance with the method of the present invention.

FIGS. 3 & 4, in which like elements share like reference characters, show details of the foil winding. FIG. 3 shows a foil winding 30 of the present invention. Cutoff pins 32 remain from the stainless steel pins shown in FIG. 2. Detail of the cutoff pins 32 is shown in FIG. 4, which is an end view of the foil winding 30. Foil sleeves 31 installed about the temporary pins prior to winding enclose the cutoff pins 32. The mandrel may be removed if required by the final application, such as to make room for a magnetic core.

Figure 5:
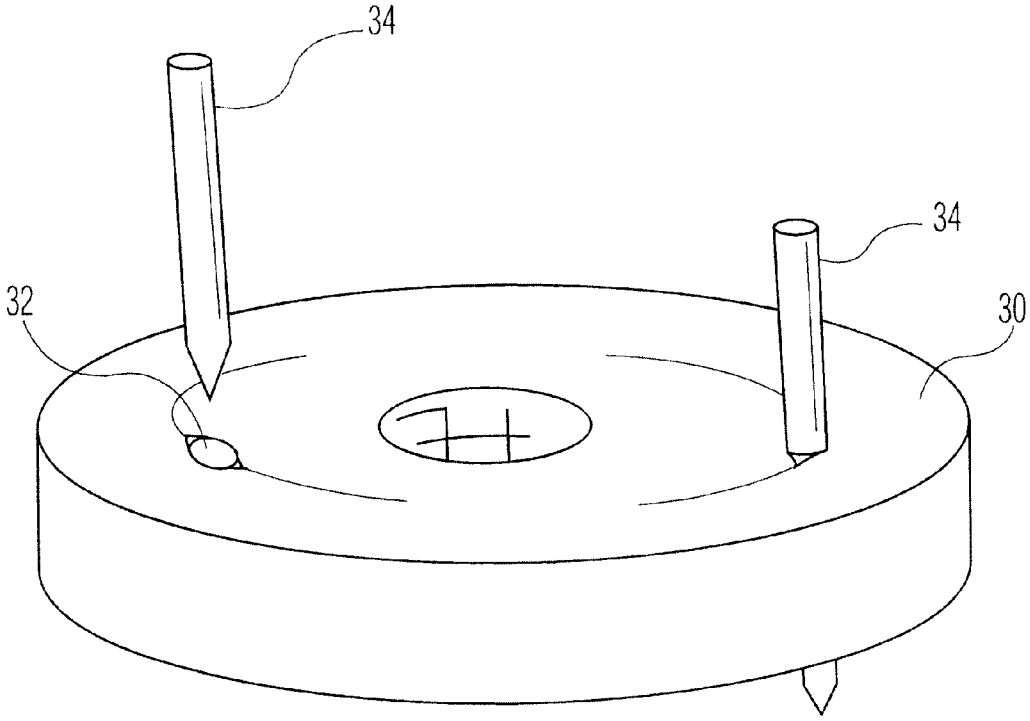
FIG. 5 shows terminal installation in a foil winding in accordance with the method of the present invention.

FIG. 5 illustrates installation of the terminals 34 in the foil winding 30. The foil winding 30 can be heated to provide expansion and provide more space for terminal installation. Terminal 34 is press fit into place in the foil winding 30, pushing out the cutoff pin 32. The press fitting is repeated for each terminal. The foil winding 30 is then allowed to return to room temperature.

Terminal 34 can be any conductive material compatible with the conductive foil and insulation film. In one embodiment, the terminal 34 is copper and has a diameter slightly larger than the diameter of the stainless steel pins. In other embodiments, the terminal 34 can be made of gold, silver, or aluminum. The terminals 34 can be etched before installation in the foil winding 30 to assure good contact with the conductive foil.

The foil winding 30 can be placed in etching solution to obtain desired separation between copper edges and insulation at the end of the foil winding 30. The etching removes any stray metal from the cutting process that could short between conductive foil layers. Additional finishing for thermal and electrical isolation can be performed prior to use.

In an alternate method, a terminal pin can take the place of the temporary pin 26 when winding the wound assembly 28. Cutoff terminals that are portions of the terminal pin remain in the foil winding 30 after cutting the wound assembly 28. Rather than pressing out the cutoff terminals, as done with cutoff pins 32 using the terminal 34 in the prior method, the cutoff terminals are left in the foil winding as the electrical connection to the conductive foil. Connectors can then be affixed to the exposed ends of the cutoff terminals by welding, soldering, or others methods.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A method of producing a foil winding with multiple terminals comprising the steps of:

providing a conductive foil;

providing an insulation film;

positioning the insulation film adjacent to the conductive foil;

forming a wound assembly by winding the insulation film and the conductive foil in a spiral pattern and positioning a temporary pin across the insulation film and the conductive foil at radial positions where terminals are desired;

cutting a foil winding from the wound assembly, the foil winding having a cutoff pin remaining from the temporary pin; and pressing terminal into the foil winding at the cutoff pin.

2. The method of claim 1 wherein the conductive foil is selected from the group consisting of copper foil, gold foil, silver foil, and aluminum foil.

3. The method of claim 1 wherein the insulation film is a polymer film.

4. The method of claim 1 wherein the polymer film is selected from the group consisting of polyethylene terephthalate film and polyester film.

5. The method of claim 1 wherein the terminal is selected from the group consisting of copper terminals, gold terminals, silver terminals, and aluminum terminals.

6. The method of claim 1 wherein the terminal is an etched terminal.

7. The method of claim 1 wherein the step of forming a wound assembly by winding the insulation film and the conductive foil in a spiral pattern and positioning a temporary pin across the insulation film and the conductive foil at radial positions where terminals are desired further comprises the step of enclosing the temporary pin in a foil sleeve.

8. The method of claim 1 wherein the temporary pin is a stainless steel pin.

9. The method of claim 8 wherein the step of forming a wound assembly by winding the insulation film and the conductive foil in a spiral pattern further comprises the step of winding the insulation film and the conductive foil on a mandrel.

10. The method of claim 9 wherein the mandrel has a substantially circular cross-section.

11. The method of claim 1 wherein the step of cutting a foil winding from the wound assembly further comprises the step of cutting a foil winding from the wound assembly using an inner diameter diamond saw.

12. The method of claim 1 further comprising the step of heating the foil winding before the step of pressing terminals into the foil winding.

13. The method of claim 1 further comprising the step of etching the foil winding.

14. The method of claim 1 further comprising the step of vacuum impregnating the wound assembly.

15. The method of claim 1 further comprising the step of encapsulating the wound assembly.

16. The method of claim 1 further comprising the step of vacuum impregnating the foil winding.

17. The method of claim 1 further comprising the step of encapsulating the foil winding.

18. A system for producing a foil winding with multiple terminals comprising:

means for positioning an insulation film adjacent to a conductive foil;

means for forming a wound assembly by winding the insulation film and the conductive foil in a spiral pattern and positioning a temporary pin across the insulation film and the conductive foil at radial positions where terminals are desired;

means for cutting a foil winding from the wound assembly, the foil winding having a cutoff pin remaining from the temporary pin; and means for pressing terminal into the foil winding at the cutoff pin.

19. A method of producing a foil winding with multiple terminals comprising the steps of:

providing a conductive foil;

providing an insulation film;

positioning the insulation film adjacent to the conductive foil;

forming a wound assembly by winding the insulation film and the conductive foil in a spiral pattern and positioning a terminal pin across the insulation film and the conductive foil at radial positions where terminals are desired;

cutting a foil winding from the wound assembly, the foil winding having a cutoff terminal remaining from the terminal pin; and affixing a connector to the cutoff terminal.

20. A system for producing a foil winding with multiple terminals comprising:

means for positioning an insulation film adjacent to a conductive foil;

means for forming a wound assembly by winding the insulation film and the conductive foil in a spiral pattern and positioning a terminal pin across the insulation film and the conductive foil at radial positions where terminals are desired;

means for cutting a foil winding from the wound assembly, the foil winding having a cutoff terminal remaining from the terminal pin; and means for affixing a connector to the cutoff terminal.

21. A method of producing a foil winding with multiple terminals comprising the steps of:

providing a copper conductive foil;

providing an insulation film;

positioning the insulation film adjacent to the copper conductive foil;

winding the insulation film and the conductive foil about a mandrel until reaching a radius where a terminal is desired;

positioning a stainless steel temporary pin across the insulation film and the conductive foil;

forming a wound assembly by winding the insulation film and the conductive foil about the mandrel until reaching a final radius;

vacuum impregnating and encapsulating the wound assembly;

cutting a foil winding from the wound assembly, the foil winding having cutoff pin remaining from the stainless steel temporary pin;

heating the foil winding; and pressing a copper terminal into the foil winding at the cutoff pin.

* * * * *